United States Patent [19]

Mattis

[11] 3,968,877

[45] July 13, 1976

[54] HIGH DENSITY TOW CARTONS

[75] Inventor: Weat Carl Mattis, Camden, S.C.

[73] Assignee: E. I. Du Pont de Nemours & Company, Wilmington, Del.

[22] Filed: June 8, 1971

[21] Appl. No.: 151,080

Related U.S. Application Data

[63] Continuation-in-part of Ser. No. 64,438, Aug. 17, 1970, abandoned.

[52] U.S. Cl. ..... 206/388; 19/66 T; 206/417; 242/159

[51] Int. Cl.[2] ..... B65D 85/671; B65H 54/84

[58] Field of Search ..... 19/66 T; 206/46 Y, 64, 206/65 Y, 83.5; 229/14 R, 14 B, 14 BA; 242/159

[56] References Cited

UNITED STATES PATENTS

| | | | |
|---|---|---|---|
| 2,780,838 | 2/1957 | Wilkie | 19/66 |
| 3,119,212 | 1/1964 | Zytka et al. | 206/46 Y UX |
| 3,120,893 | 2/1964 | Guenther et al. | 206/83.5 |
| 3,206,021 | 9/1965 | Smith et al. | 206/83.5 |
| 3,214,798 | 11/1965 | Cook | 206/46 Y UX |
| 3,351,992 | 11/1967 | Carter | 206/46 Y UX |

FOREIGN PATENTS OR APPLICATIONS

| | | | |
|---|---|---|---|
| 652,926 | 6/1965 | South Africa | 206/46 Y UX |
| 881,812 | 11/1961 | United Kingdom | 206/46 Y UX |

*Primary Examiner*—Steven E. Lipman

[57] ABSTRACT

Package for the storage and shipment of acrylic tow comprising a substantially filled container wherein the acrylic tow is in the form of a self-supporting block having a density of at least 22 lbs./ft.$^3$.

2 Claims, 3 Drawing Figures

INVENTOR
WEAT CARL MATTIS
BY Gary A Samuels
ATTORNEY

HIGH DENSITY TOW CARTONS

CROSS-REFERENCE TO RELATED APPLICATION

This application is a continuation-in-part of application Ser. No. 64,438, filed Aug. 17, 1970, now abandoned.

BACKGROUND OF THE INVENTION

This invention relates to packages of acrylic fibers. More specifically, the invention is concerned with forming packages of acrylic filamentary tow having a density higher than conventional packages of acrylic tow. The invention is particularly concerned with a form of package for a filamentary tow of acrylic fibers having a shrinkage of not more tha 3% which is more economical for shipping and handling and provides for greater utilization of storage space with less damage to packages for such fibers than provided by packages heretofore known in the art.

Many forms of packages for supplying tow and staple for subsequent textile processing are known in the art. Such forms include compressed bales which are strapped, or wrapped with a covering material and subsequently strapped. A typical convenient process for packaging acrylic tow is to piddle it into a carton made of conventional paperboard usually with an interliner of plastic film. The customer can readily utilize fiber in such a package by opening the top of the carton, finding the end of tow and withdrawing the tow. The package need not be unwrapped and no straps need to be cut. Further, the fiber is protected until it is actually withdrawn and used.

The advantage of supplying acrylic tow in containers such as paperboard cartons rather than as bales is readily apparent.

More densely packed containers of acrylic tow than those presently in use are desired for economy in shipping and handling. More fiber can be shipped in less volume. Further, more densely packed containers would reduce damage which may occur in storage of less densely packed containers when one carton of acrylic tow is stored on top of another. A low density or underfilled carton may tend to crush under the combined weight of cartons stored on top of it, or be damaged at the sides of the package if elevated by a lift truck employing a squeeze grip pick-up force.

SUMMARY OF THE INVENTION

The product of the present invention is a package for the shipment and storage of acrylic tow comprising a closed free-standing nonbulging container substantially filled with a self-supporting block consisting essentially of a tow of acrylic fibers having a shrinkage of not more than 3% and a moisture content of not more tha 2%, said block having a density of at least about 22 lbs./ft.$^3$, said tow being readily withdrawable from said block for textile processing.

Preferably, the density of the fiber block is between about 25–35 lbs./ft.$^3$ and most preferably between about 25–33 lbs./ft.$^3$.

Preferably, the container is a flat sided paperboard carton.

In a preferred embodiment, the acrylic fiber comprising the tow consists essentially of a copolymer of between about 93–95% by weight acrylonitrile and between about 5–7% by weight methyl acrylate with the proviso that there may also be present up to 1% sodium styrenesulfonate, all parts based on the total weight of the polymeric components.

Typically, the paperboard carton has a polymeric film liner which surrounds the filamentary block within the container.

The denier of the tow is not critical. It may have a denier between 100,000 and 1,000,000 or more and the filaments comprising the tow typically have a denier of between 1 to 10.

Typically, the product is a single component fiber having a crimp level of between about 5 to 15 crimps/inch. However, the invention also includes in its scope the package wherein the acrylic tow is of bicomponent fibers.

In its broadest form, the process of this invention comprises the steps of providing a free standing container having the dimensions of the package to be prepared, said container having an opening at the top; providing an extending member on said top temporarily extending the height of said container; heating a tow consisting essentially of acrylic fibers to a temperature not exceeding 160°C. to provide a tow of fibers having a shrinkage of not more than 3% and a moisture content of not more than 2% by weight and advancing said tow at a rate of at least 60 yds./min. through said extending member at a temperature not exceeding 125°C. and at a minimum temperature of at least 50°C. when the heating of said tow is carried out in an atmosphere having a water vapor content of 40% or more by volume, and of at least about 75°C. when the heating of said tow is carried out in an atmosphere having a water vapor content of less than about 40% by volume; compressing said deposited tow into the container to a density of at least 16 lbs./ft.$^3$ by pressure applied substantially uniformly across the cross section of the container defined by the opening, removing the extending member, and closing the container.

In one preferred process embodiment of the invention, the heating of said two is carried out in an atmosphere having a water vapor content of at least 40% by volume. In employing this embodiment of the invention, it is observed that cartons of the packed tow have a higher density than cartons of packed tow which have been heated in an atmosphere of lower water vapor content. Surprisingly, the color of the tow is also superior to the color of the tow heated at the same temperature in an atmosphere of lower water vapor content.

The preferred process embodiment by which the novel product of the invention is produced comprises the steps of providing a free standing container having the dimensions of the package to be prepared, said container having an opening at the top; providing an extending member on said top temporarily extending the height of said container; advancing at a rate of at least 60 yds./min., tow consisting essentially of acrylic fibers having a shrinkage of not more than 3% and a moisture content of not more than 2% by weight into said container and extending member through said extending member at a temperature between about 75°–125°C., until an amount of fiber equal to the desired density multiplied by container volume to be filled is deposited, compressing said deposited tow into the container without bulging the container walls, to a block density of at least about 22 lbs./ft.$^3$ by pressure applied substantially uniformly across the cross section of the container defined by the opening, removing the extending member, and closing the container. By this process there is obtained a closed nonbulging container substantially filled with a self-supporting block of said tow, said block having a density of at least about 22 lbs./ft.$^3$.

Preferably, the tow being fed to the container is at a temperature of between about 90°C. to 110°C.

In a highly preferred embodiment the tow being fed to the container is heated to a temperature of between 125° – 160°C. in an atmosphere having a water vapor content of at least 40% by volume until the tow contains not more than 2% moisture after which the tow is cooled and advanced to the carton at a temperature of 75° – 125°C.

Typically, the carton is lined with a polymeric film such as polyethylene film.

Preferably, the tow will be advanced at a speed of at least 120 ypm. and most preferably at speeds between 150 to 300 ypm.

The block of acrylic fiber contained within the packed carton of the present invention is hard, block-like and resistant to crushing. In this respect, it differs markedly from the mass of acrylic fiber contained in conventional packed cartons, which is lively and compressible. However, the acrylic tow is easily withdrawn from its hard, block-like form ready for normal textile use, and it retains its crimp and other valuable properties. Continuous filamentary tow packed in accordance with the invention is readily processed on conventional stretch-breaking machines to form excellent slivers of acrylic staple fibers; and it is found that the tow bundle is advantageously narrower than conventional tow bundles. Tows which are quite wide are difficult to handle in this step.

In shipping and handling, the packed carton of the present invention is much sturdier than the conventional packed carton, in which the packed carton is filled substantially exactly by the hard block of acrylic fiber. Less fiber damage is encountered in handling the packed cartons of the present invention than with conventional cartons, and the heavier cartons according to this invention (more weight per package volume) may be stacked acceptably in storage to a height of as many as 5 cartons. Because of the load bearing capacity of the packed tow, cartons of lesser wall thickness may be used thereby providing improved economics. The cartons of the present invention may be sealed simply by taping them, and they do not require strapping, which is advantageous both in the packing and unpacking operations.

DESCRIPTION OF THE DRAWINGS

The process and product are further described below with reference to the Figures in which

FIG. 1 is a simplified drawing of conventional carton filling apparatus.

Figure 1:
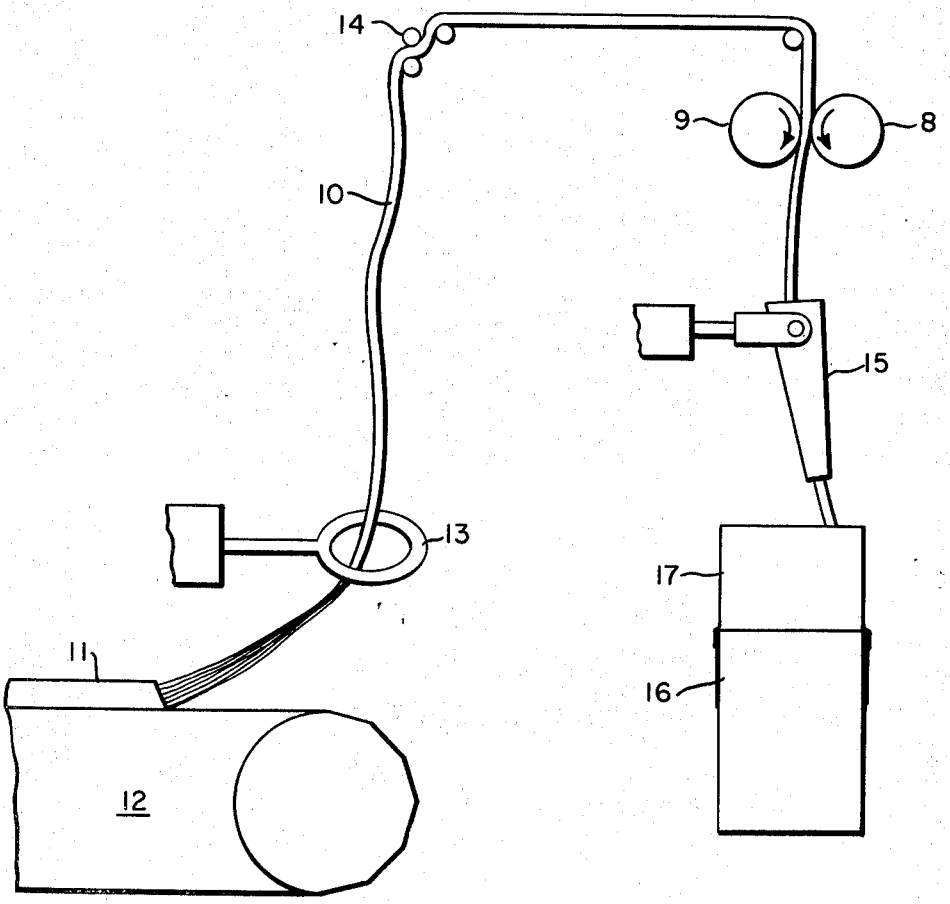
FIG. 1 is a schematic of a typical filling operation.

The piddling process for filling cartons of the type shown in Amos is preferred. Other conventional routes for uniformly filling cartons with tow are also operable with this invention.

DEFINITIONS

"Free standing container" as used herein means a container which is self-supporting and defines its volume and shape by its construction. The volume or shape of the container is not determined by its contents. An assembled paperboard carton is a typical free standing container. Typical containers useful with this invention are those paperboard cartons currently in use in the trade for shipment of acrylic tow. Typically, these have a minimum cross-sectional dimension between 1 and 4 feet. The wall thickness is usually between 3/16 inch and ½ inch. The carton walls have a bursting strength of at least 275 pounds and preferably at least 500 pounds as measured by the standard Mullen Burst test used in the industry (ASTM D-774). Cylindrical paperboard cans and the like are other examples of free standing containers.

"Nonbulging" as used herein refers to the property of the packed container. When the packed container is resting on an end, the sides do not significantly bend outward as a result of the highly densified packed tow in the container. A container is considered bulged when the pressure of the contents causes an outward protrusion of more than ½ inch on any sidewall of the packed container at any point. This can be determined by ascertaining the plane of the sidewall of the free standing container and determining the protrusion therefrom.

"Substantially filled" means that the high density block of acrylic fiber fills the container so completely that there is not more than 1 inch of space between the inside wall of the container top and the top external dimension of the block of tow therein. Preferably the tow will fill the container to less than ½ inch from the top.

"Self-supporting" means that the block of acrylic fiber retains its own shape under its own weight. The block will retain its shape after the container is cut away. "Readily withdrawable for subsequent use" means that the continuous length of tow or tows forming the package may be withdrawn from the package as a tow by the application of force to one end thereof (pulling on the end).

The extending member tkes the form of an extension of the walls of the container on all sides and most typically is a chute or sleeve with a ledge to rest on or grip onto the upper edges of the walls of the container to provide for ready filling of the container with tow. Figerglass, metal and paperboard are suitable materials of construction for the extending member. It should be readily removable from the container to be filled for ease in the packing operation.

The compacting pressure is applied by a ram into a cross section that approximates the cross section defined by the open top of the container. Typically, the ram face has a smaller cross section than the container to provide for the escape of air from the carton during compaction.

Shrinkage is determined as follows: a sample of given length ($L_o$) of the filaments in the tow is submerged in boiling water (at atmospheric pressure) for 30 minutes. The sample is then dried for 30 minutes in air at 70°C. The length ($L_b$) is then measured. Percent shrinkage is calculated as $$\left(\frac{L_o - L_b}{L_o}\right) \times 100$$

and Moisture Content is determined by the Standard Karl Fischer Reagent Determination Method (ASTM E-203).

"Acrylic" as used herein, includes any long chain synthetic polymer composed of acrylonitrile units of the formula

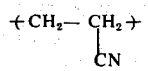

in the polymer chain. As is well understood, the term includes the homopolymer of acrylonitrile (i.e., polyacrylonitrile) and copolymers of acrylonitrile and one or more suitable monoethylenically unsaturated monomers copolymerizable with acrylonitrile. Among the typical addition monomers as exemplary of those which are copolymerizable with polyacrylonitrile are methyl acrylate, methyl methacrylate, vinyl acetate, styrene, methacrylamide, methacrylonitrile, vinyl chloride, vinylidene chloride, methyl vinyl ketone and the like as well as any of the available vinyl pyridines. The preferred compounds include methyl acrylate, vinyl acetate, styrene and the vinyl pyridines.

Among the copolymerizable sulfonates are the sulfonated styrenes, vinyl sulfonate, allyl sulfonate, methallyl sulfonate and their alkali-metal or alkaline-earth-metal salts, and the like, it being necessary only that the compound chosen from this class be copolymerizable with acrylonitrile to the desired extent. The preferred compounds are the sulfonated styrenes.

In addition to homofiber (single component) compositions, acrylic bicomponent fibers are also applicable to the package and process of this invention. Typical bicomponent fibers are exemplified by those prepared from two acrylic polymeric components selected from the group consisting of polyacrylonitrile; copolymers consisting essentially of at least about 88% by weight acrylonitrile and up to 12% by weight of at least one member of the group consisting of addition monomers including those bearing sulfonate groups; and mixtures of two or more of said polymers, the two components being present in the cross section in a weight ratio in the range of 75/25 to 25/75, said components differing by at least 1% by weight in copolymerized monomer.

"Bicomponent fiber", as used herein, includes composite fiber which contains two acrylic components in a side-by-side relationship in the cross section of the fiber and extending substantially throughout the length of the fiber, so that each constitutes a portion of the fiber surface. These bicomponent fibers are characterized by their tendency to develop helical crimp, which in some cases is present in the fiber as produced, or may be developed by subsequent treatment. Reversals in the direction of helices may occur frequently in the fibers.

DISCUSSION OF THE INVENTION IN DETAIL

The temperature at which the tow is deposited in the container according to this invention is measured on the tow in the container or at any time within 2 seconds of deposition (the time of repose) of the tow in the container.

To prepare the high density package of tow of acrylic fibers according to this invention, the acrylic tow is heated to the elevated temperature of between about 125°C. and 160°C. in an atmosphere containing water vapor, as set forth above before compression in forming the high density package, and is then advanced into the container at a temperature between about 50° and 125°C., depending on the water vapor content of the drying atmosphere, also as set forth above. As will be understood, some tows of acrylic fibers such as those of different comonomer content may have to be heated to temperatures in excess of those required for other acrylic fibers to prepare the product of this invention. Thus, for some acrylic fibers it may be necessary to heat the tow to at least 80°C. or 85°C. or more before the desired compaction can be accomplished. For example, for a tow of fiber of 6 denier filament of acrylonitrile/methyl acrylate/sodium styrenesulfonate terpolymer (93.9%/6%/0.1%), it may be necessary to heat the filaments to about 85°–90°C. to prepare the block-like package of the present invention. Similarly, for tow comprised of 3 denier filaments consisting of acrylonitrile sodium styrenesulfonate copolymer (96.0%/4.0%), it may be necessary to heat the tow to temperatures slightly in excess of 100°C. to prepare the block-like product of the present invention. Advancing temperatures in excess of 125°C. tend to discolor the fiber since the rate of cooling in the container is slow.

Typically, the fiber of the tow to be packaged is crimped and the fiber in the package retains the original crimp configuration and does not obtain a superimposed microcrimp as a result of hot packing. The typical superimposition of a low frequency macrocrimp as in cold packing of tow does occur without any deleterious effect to the tow. Typically in the single component (homofiber) fiber the crimp is a herringbone crimp put in by the "Stuffer box" method and is at a level of 5 to 15 crimps/inch.

It is desired to exert the minimum pressures in the packing process to minimize the possibility of bulging the container. Desirably, the container walls are unsupported during the packing process for economy and speed in the packing process and the container is a paperboard carton. Compression pressures of not more than about 10 psi are preferred. Most preferably pressures of not more than about 5 psi are used.

The amount of time the compressive force is held on the tow is not critical. The hot fiber tow readily compacts into the configuration of the container, thus substantially filling it. The typical time of compression (holding the tow in its final compact configuration) is between about 3 to 8 minutes. Compression is usually carried out immediately after filling the container. However, because the rate of cooling of the filled container is slow, some time lag between filling and compression can be tolerated.

With reference to FIG. 1 of the drawings, tow 10 is withdrawn from a loosely-arranged bed 11 on a continuous, perforated belt drier 12, by a pair of pull rolls comprising driver 8 and idler 9, through a system of guides schematically represented by loop guide 13 and parabolic guides 14. The guides are arranged to permit removal of folds and twists in the tow and to shape it to approximately the desired width, while maintaining good filament distribution uniformly. Normally, minor differences in tow paths which are required to direct the tow from the various locations on the drier bed to the several packaging stations result in a non-uniform tension requirement station-to-station. This results in variations in relaxed tow width, or width of the tow as it is dropped into the carton, and normally these variations are compensated for by adjustment of the closing force applied to idler roll 9. After leaving the pull rolls, tow 10 drops from piddler spout 15 into carton 16. Piddler spout 15 is driven by means (not shown) to distribute the tow uniformly over the cross sectional area of tow carton 16.

Means may be provided for adjusting the nip pressure on rolls 8 and 9 as taught by Amos.

The tow carton 16 is provided with an extending member 17 extending the effective height of the carton and volume of fiber collected in this step.

In conventional practice, the tow is relatively cool as it leaves the dryer, the temperature usually being well under 60°C. and it is packaged at temperatures below those used in the present invention. In accordance with the preferred embodiment of the invention, a high temperature is used in the last zone of the dryer, preferably greater than 125°C., e.g., as high as 160°C; and the amount of cooling air drawn through the dryer belt 12 is sufficient only to regulate the temperature of the tow, suitably measured at the pull rolls within 2 seconds of deposition of tow in the carton at the desired level. A suitable means for measuring the temperature of the tow at the rolls is an infrared thermometer such as that provided by the Williamson Company, Model 1200. The compression step in the container is usually carried out immediately after the carton is filled, although the timing of this step is not crucial, since the rate of cooling of the hot fiber in a substantially filled paperboard carbon is only about 1°C. per hour.

After the desired amount of hot dry (containing not more than 2% moisture) tow is deposited in the carton and extending member, the mass of tow uniformly distributed across the cross section of the carton 16 and extending member 17 is compressed by ram 18, activated by means not shown to compress the tow to the desired density, at least about 22 lbs./ft.$^3$, substantially filling the carton. The carton walls are unsupported in the compression step and do not bulge when the process is practiced according to this invention. Further, the fiber tow after compaction is "dead". It does not bloom on the removal of the compacting force and substantially fills the carton.

As aforementioned, the amount of tow to be deposited can be calculated by:

Amount of tow = desired package density × container volume to be filled

If changes in the tow forming process alter the length of tow which will substantially fill a container, the temperature of the feed tow or the compacting pressure can be adjusted to provide substantially full containers.

Figure 2:
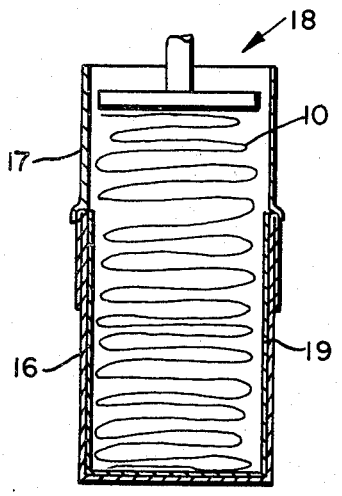
FIG. 2 is a schematic of the compression step and FIG. 3 is a schematic of the product. The carton filling apparatus described in Amos, U.S. Pat. No. 3,204,295 is a suitable apparatus with the addition of extending member 17.

Reduction in temperature of the feed tow or compacting pressure results in packed containers of lower density. Reduction in temperature of the tow is conveniently accomplished (with reference to FIG. 1) by increasing the amount of cooling air provided to the drier belt 12. While FIGS. 1 and 2 provide the preferred method and means for carrying out the process of the present invention, other heating means as known in the art are suitable for heating the tow to the desired temperature. The process here described is preferred in that it is coupled with the drying process which reduces the moisture level of the acrylic tow to less than 2% as required. Alternatively the packaging process can be carried out in a separate step from the drying operation.

Figure 3:
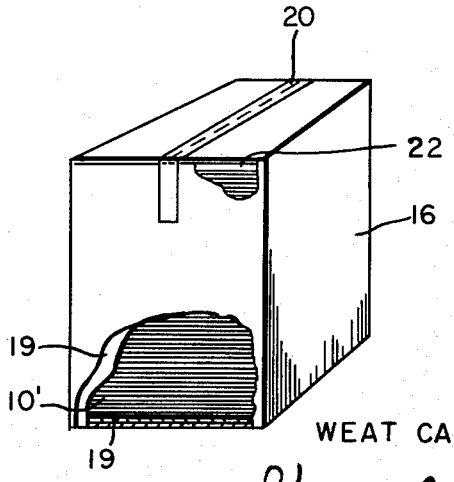

FIG. 3 is a schematic of the product of this invention and shows carton 16 substantially filled with a self-supporting block of tow 10′ having substantially the same properties when withdrawn from the container as tow 10. The tow is arranged in a zigzag overlapping manner uniformly distributed throughout the carton. There is a liner of polymeric film 19 between the carton 16 and the block of tow 10′. The nonbulging carton after being closed may be simply sealed with a gum tape closure.

The carton is substantially filled with tow. "Freeboard space" 22 of no more than one inch, preferably less than ½ inch at the top of the package may be present.

The process of this invention has further advantages related to the production of tow of acrylic fibers. In conventional processing the packing operation and drying operation are supplied with a given cut length of tow for further cutting to a fill specified number of cartons. Variations in manufacturing conditions may cause the volume of the packed tow to be either lower or greater than a predetermined standard level resulting in overfilling or underfilling of a carton. As aforementioned, the possibility of carton damage in shipping and storage is severely increased by underfilling. As the volume of packed tow temporarily becomes higher than the standard level and overfills the carton, it is necessary to cut the surplus to waste. With the process of the present invention, however, variations in the amount of fiber which substantially fill a carton may be compensated for by raising the temperature at which the tow is fed to the carton thereby increasing the density of the package, or lowering the temperature slightly (but above 75°C.), thus, lowering the density of the block which substantially fills the carton. With either compensation, substantially filled cartons according to the present invention are prepared.

Further, more than one length of tow can be incorporated in a package if this is desired. Upon discontinuing the piddling of one tow into the container the end may be tagged. The second tow may be piddled on top of the first and discontinued when the amount necessary to substantially fill the carton has been deposited. Compression is then applied.

In the Examples which follow, all parts are by weight unless otherwise indicated.

EXAMPLE I

Filaments of acrylonitrile/methyl acrylate/sodium styrenesulfonate terpolymer (93.9%/6.0%/0.1%) are spun from dimethylformamide solution in the conventional manner, gathered into ropes, and collected in a large can as in conventional processing. The rotes of the spun filaments are then further combined into a tow and are wash-drawn at a draw ratio of 4.5× in an aqueous bath at 96°C., crimped to a level of about 6crimps/inch in a stuffer-box crimper, and again collected in a can in conventional manner. The collected tow has a moisture content of approximately 30%. The tow has a dry denier of approximately 470,000. The filaments have a dry denier of approximately 6.

The moist tow is withdrawn from its can and passed into a conventional tow dryer, in which the tow is piddled onto a moving belt which passes through a series of zones in which air at about 135°C. containing about 20% moisture by volume is passed downward through the tow to dry it. At the end of the dryer, the tow passes through a final, unheated zone through which air at room temperature is drawn slowly through the bed at a rate which may be regulated, so that the temperature of the tow leaving the dryer can be regulated. The tow has not more than 3% shrinkage and no more than 2% moisture content. The tow is then forwarded at a rate of 190 yds./min. by means of pull rolls directly to a position above the packing carton and its surmounting container extending member into which the tow is traversed in a zigzag laydown pattern by a traversing spout by means of the type shown in FIG. 1. The rolls 8 and 9 are five feet from the top of the extending member and 4 yards from the bottom of the carton to be filled. The temperature of the tow, measured at the pull rolls, 8 and 9 is 100°C. (99°–102°C., based on observed lower and upper temperatures of 210°–215°F.). The carton into which the hot tow is piddled at 190 yds./min. has the following measured dimensions: length, 28⅛ inches; width, 24⅝ inches; and height, 40 inches. The carton is made of corrugated paperboard having a wall thickness of 5/16 inch, and a volume of 16 cubic feet (the carton wall has a bursting strength of 500 pounds as measured by the Mullen Burst test). The surmounting container extending member comprises a fiber glass extension having the same inside dimensions as the carton and a height of 40 inches. The interior of the carton is lined with a polyethylene film sleeve having a periphery as large as the periphery of the carton and gathered at the bottom of the carton to cover the bottom. Piddling of the hot tow is discontinued by cutting the tow and removing the carton and surmounting member from the position below the tow piddler. The carton and surmounting member is then moved to a position beneath a hydraulic ram having dimensions slightly smaller than the inside dimensions of the carton to allow for the escape of air. The ram is then pushed into and through the surmounting member at a pressure of about 5 psi., compressing the hot tow for a time of about 6 minutes until all of the tow is contained within the carton. The ram is then withdrawn, the surmounting member is removed, and the upper flaps of the carton are then folded over to close the carton. The net weight of the acrylic tow in the carton is 404 pounds (25.2 pounds per cubic foot density). The tow in the carton is a self-supporting hard block. The cartons are not bulged.

The acrylic tow can be withdrawn easily from the cartons.

EXAMPLE II

A filamentary acrylic tow is spun and drawn as in Example I, using terpolymer of the same composition. The moist tow is then dried under the same conditions described in the example, except that the air in the dryer is maintained at a level of about 70% water vapor by volume, the temperature being about 135°C. During the operation of the dryer, several changes are made in the rate at which room temperature air is drawn through the final unheated zone at the exit of the drier, so as to change the temperature of the dried tow, measured at the pull rolls. Upon reaching equilibrium of the tow temperature after each change, full cartons are packed. The following data are observed:

| Measured Temp. | Net Weight of Tow in Package | Tow Density |
|---|---|---|
| 104°C. (219°F.) | 482 lbs. | 30.1 lbs./ft.$^3$ |
| 103°C. (217°F.) | 466 | 29.1 |
| 100°C. (212°F.) | 433 | 27.1 |
| 82°C. (180°F.) | 412 | 25.8 |
| 79°C. (174°F.) | 389 | 24.3 |
| 79°C. (174°F.) | 356 | 22.2 |

The tow in the carton is a self-supporting hard block. The cartons are not bulged.

The acrylic tow can be withdrawn easily from the cartons.

Examples I and II above illustrate the preparation of the preferred, hard, block-like carton of the invention containing acrylic tow having a density of at least 22 lbs./ft.$^3$. The above two examples also illustrate the preferred process embodiment in which the tow is packed at a temperature between about 75° and 125°C. By comparison of Example II with Example I, it will be noted that packing the tow at 100°C. after heating it in an atmosphere of high water vapor content provides a higher density than packing it at the same temperature after heating it in an atmosphere of low water vapor content. In accordance with a more general aspect of the process of the present invention, it has been found that heating the tow in an atmosphere of high water vapor content prior to packing produces packed cartons of relatively higher density even below the preferred temperature range of 75°–125°C. This is further illustrated in the following example.

EXAMPLE III

The procedure of Example II, in which the tow is heated, prior to packing, in a dryer maintained at a level of about 70% water vapor by volume at about 135°C. and packed at various temperatures in the range of 79°–104°C., is repeated; except that the tow is packed at a temperature of 62.8°C. (145°F.). The net weight of the acrylic tow in the carton is 304 lbs. (19.0 lbs./ft.$^3$ density). The packed tow is somewhat block-like in form, although it retains some resiliency and is not a hard block.

Example I, in which the tow is heated by drying it in air at about 135°C, containing about 20% water vapor by volume and packed at a temperature of about 100°C., is repeated; except that the tow is packed at a temperature of about 62.8°C. (145°F.). The net weight of the acrylic tow in the carton is 256 lbs. in this instance (16.0 lbs./ft.$^3$ density). The packed tow exhibits resiliency and is not in the form of a hard block.

The above data, employing packing temperatures of 62.8°C., together with the results of Examples I and II, employing a packing temperature of 100°C., are summarized in the table below.

| Volume of Water Vapor In Preheating Air | Density of Packed Tow Carton | |
|---|---|---|
| | Carton Packed at 62.8°C. | Carton Packed at 100°C. |
| 70% | 19.0 lbs/ft$^3$ | 27.1 lbs/ft$^3$ |
| 20% | 16.0 | 25.2 |

As illustrated in the following example, an improvement in the color of the tow as well as a higher density of the tow carton can be obtained by drying the tow in an atmosphere of high water vapor content, as compared with drying the tow at a lower water vapor content. In this example, the drying step is carried out at 135°C. in both instances; and the tow cartons are packed at substantially the same temperatures in the range 60°–70°C.

EXAMPLE IV

A filamentary acrylic tow is spun and drawn as in Example I, using terpolymer of the same composition. The moist tow is withdrawn from its can and passed into a conventional tow dryer, in which the tow is piddled onto a moving belt which passes through a series of zones in which hot, moist air is passed downward to the tow to dry it. The measured temperatures in the first three zones are 142°C., 133°C., and 139°C., respectively. The air passed through the tow has a water vapor content of approximately 40% by volume, estimated from wet and dry bulb measurements. At the end of the dryer, the tow passes through a final, unheated zone through which air at room temperature is drawn slowly through the bed at a rate which may be regulated, so that the temperature of the tow leaving the dryer can be regulated. Full cartons of the tow are packed as described in Example I, the temperature of the tow being 66.6° ± 2.8°C. (150° ± 5°F.). The hot tow is piddled into the carton at 178 yds./min. The net weight of the acrylic tow in the carton is 324 pounds (20.25 lbs./ft.$^3$ density). The tow has a "*b* Value" color of 1.5, measured on samples taken at the pull roll.

In a comparative test, tow spun and drawn in the same manner as described in the paragraph above is dried using hot air having a water vapor content of only 11% by volume. The measured temperature of the air is 142°C. in all three zones, measured above the bed. The packing temperature of the tow, measured at the pull rolls, is 62.8° ± 2.8°C. (145° ± 5°F.). The net weight of the acrylic tow in the carton is 277 pounds (17.3 lbs./ft.$^3$ density). The two has a "*b* Value" color of 1.8, measured on samples taken at the pull roll.

The tow dried under conditions of elevated water vapor content thus has a better color and higher carton density than the tow packed at approximately the same temperature but dried at a lower water vapor content. The tow dried under moist conditions also is more block-like than the tow dried with very dry air, although the tows in both packages retain some resiliency and neither is a hard block.

The following example illustrates obtaining a carton of acrylic tow of equivalent color but much higher carton density than a conventional carton of acrylic tow by drying the tow in an atmosphere of high water vapor content, as contrasted with drying it in an atmosphere of low water vapor content. In the example, the drying step is carried out at 135°C. in both instances; but the carton of tow preheated at high water vapor content is packed at 79°C. as contrasted with a 63°C. packing temperature for the tow dried in an atmosphere of low water vapor content.

EXAMPLE V

The color of a sample of tow packed according to the procedure of Example II, in which the tow is dried prior to packing in a dryer maintained at a level calculated as about 70% water vapor by volume at about 135°C. and packed at 79°C., is measured. The tow has a "*b* Value" color of 1.7, measured on samples taken at the pull roll, and the net weight of the acrylic tow in the carton is 389 lbs. (24.3 lbs./ft.$^3$ density). The tow in the carton is a self-supporting hard block.

The color of a sample of tow prepared in accordance with the second paragraph of Example III is measured. This tow is heated by drying it in air at about 135°C. containing about 20% moisture by volume and packed at a temperature of about 62.8°C. (145°F.). The tow has a "*b* Value" color of 1.8, measured on samples taken at the pull roll; and the net weight of acrylic tow in the carton is 256 lbs. (16.0 lbs./ft.$^3$ density). The packed tow exhibits resiliency and is not in the form of a hard block.

As shown above, using the most preferred process embodiment of the invention, tow of equivalent or slightly superior color can be packed at high carton density in hard, block-like form.

The *b* value color as determined by a method proposed by Adams using color coordinates tables (Modified Adams' Chromatic Value System) is well known in the trade. The diffuse light reflectance of air opened pads, made from the dried fibers, is measured with a colorimeter equipped with a sample rotator and a photo-tube cut-off switch. (A suitable colorimeter is the Tristimulus Model V Differential Colormaster colorimeter, manufactured by Manufacturing Engineering and Equipment Company, Hatboro, Pennsylvania, and calibrated against the manufacturer's reference plates and the National Bureau of Standards certified reflectance plates.) The sample rotator is a device which spins the sample as the reflectance is being measured to average out differences which may be caused by fiber orientation.

The foregoing detailed description has been given for clearness of understanding only and no unnecessary limitations are to be understood therefrom. The invention is not limited to the exact details shown and described for obvious modifications will occur to those skilled in the art.

The embodiments of the invention in which an exclusive property or privilege is claimed are defined as follows:

1. A package for the shipment and storage of acrylic tow comprising a closed, free-standing, nonbulging, flat-sided, paperboard container substantially filled with a self-supporting block consisting essentially of a tow of acrylic fibers having a shrinkage of not more than 3% and a moisture content of not more than 2% by weight, said block having a density between about 25 and 33 lbs/ft$^3$, and said tow being readily withdrawable from said block for textile processing.

2. A package for the shipment and storage of acrylic tow comprising a closed, free-standing, nonbulging, flat-sided, paperboard container substantially filled with a self-supporting block consisting essentially of a tow of acrylic fibers having a shrinkage of not more than 3% and a moisture content of not more than 2% by weight, said block having a density of at least about 22 lbs/ft$^3$, said tow being readily withdrawable from said block for textile processing, and said acrylic fibers of the tow consisting essentially of a copolymer of between about 93–95% acrylonitrile, between about 5–7% methyl acrylate and up to 0.5% sodium styrenesulfonate, all parts being by weight of the total polymeric components present.

* * * * *